United States Patent [19]

DeTorre

[11] 4,263,754

[45] Apr. 28, 1981

[54] SHAPING AN ARCUATE SURFACE ON A WHEEL BLANK

[75] Inventor: Robert P. DeTorre, Pittsburgh, Pa.

[73] Assignee: PPG Industries, Inc., Pittsburgh, Pa.

[21] Appl. No.: 52,388

[22] Filed: Jun. 27, 1979

[51] Int. Cl.[3] ..... B24B 1/00

[52] U.S. Cl. ..... 51/288; 76/85

[58] Field of Search ..... 51/125, 288, 326, 328; 76/81–87

[56] References Cited

U.S. PATENT DOCUMENTS

| | | | |
|---|---|---|---|
| 681,440 | 8/1901 | Clizbe | 76/85 |
| 738,901 | 9/1903 | Goodenow | 76/85 |
| 1,945,501 | 2/1934 | Angell | 51/278 |
| 2,975,567 | 3/1961 | Little | 51/328 X |
| 3,581,439 | 6/1971 | Jensen | 51/328 X |
| 4,057,184 | 11/1977 | Michalik | 30/164.95 X |

*Primary Examiner*—Gary L. Smith

*Attorney, Agent, or Firm*—Donald Carl Lepiane

[57] ABSTRACT

A wheel blank having an angled peripheral surface is mounted on a dead spindle. The angled surface is biased against a felt pad having polishing compound to shape an arcuate scoring surface on the wheel blank.

4 Claims, 5 Drawing Figures

SHAPING AN ARCUATE SURFACE ON A WHEEL BLANK

BACKGROUND OF THE INVENTION

1. Field of the Invention

This invention relates to a method of shaping a scoring surface on a wheel blank.

2. Discussion of the Prior Art

U.S. Pat. No. 4,057,184 teaches a method of scoring a glass piece with a wheel having an arcuate scoring surface. The prior art e.g., U.S. Pat. Nos. 738,901; 1,945,510; 2,975,567; and 3,581,439 teaches various techniques for shaping wheel peripheries. Although the shaping techniques are acceptable, they do not provide sufficient control to provide a scoring surface of a predetermined radius on a wheel blank. It would be advantageous therefore to provide a method of shaping a wheel blank that does not have the drawback of the prior art.

SUMMARY OF THE INVENTION

This invention relates to a method of shaping a wheel blank to provide an arcuate scoring surface on the wheel periphery. The rotating axis of the wheel blank is mounted on a spindle and subtends a predetermined angle with a plane containing a shaping pad. The wheel and pad are biased against each other and rotated relative to one another to shape a scoring surface on the periphery of the wheel blank.

DESCRIPTION OF THE INVENTION

Figure 1:
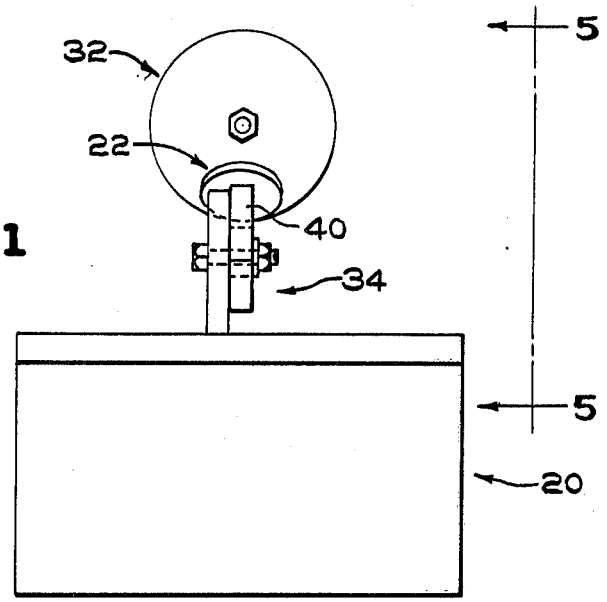
FIG. 1 is a front elevated view of a shaping apparatus that may be used in the practice of the invention.
Figure 5:
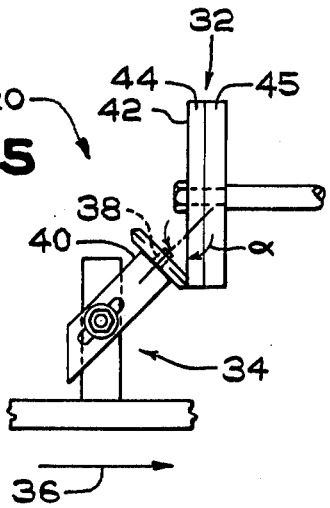
FIG. 5 is a view taken along lines 5—5 of FIG. 1.
Figure 2:
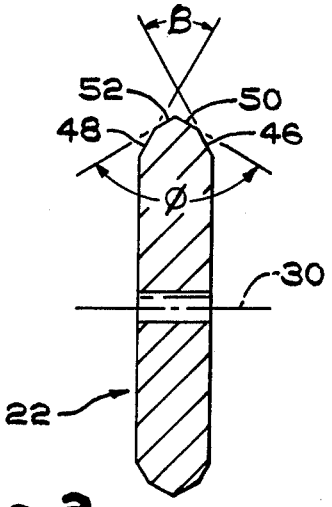
FIG. 2 is a cross-sectional view of a wheel blank that may be used in the practice of the invention.
Figure 3:
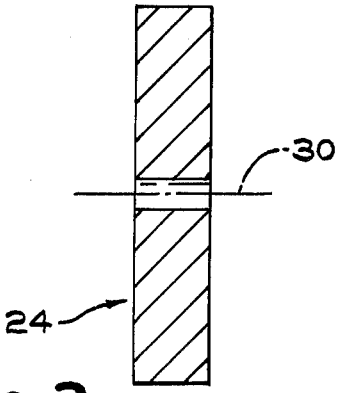
FIG. 3 is a cross-sectional view of another type of wheel blank that may be used in the practice of the invention.
Figure 4:
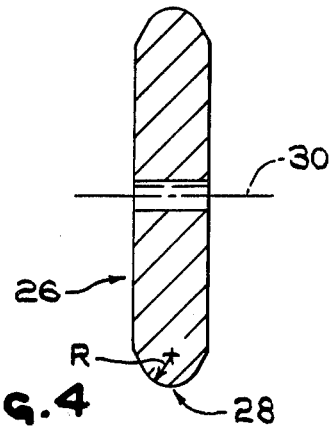
FIG. 4 is a cross-sectional view of a scoring wheel having an arcuate scoring surface shaped thereon in accordance to the teachings of the invention.

Shown in FIG. 1 is an apparatus 20 for shaping a wheel blank 22 or 24 shown in FIGS. 2 and 3 respectively to provide a refractory scoring wheel 26 shown in FIG. 4 having a radiused or arcuate scoring surface 28. As used herein the terms "radiused scoring surface", "arcuate scoring surface" or "radius of curvature of the scoring surface" are defined as the scoring surface of the scoring wheel having a radius R when viewed through a plane containing the rotating axis 30 of the scoring wheel e.g. as shown in FIG. 4. In general and with reference to FIGS. 1 and 5, the shaping apparatus 20 includes a rotating shaping wheel 32 and mandrel 34 for supporting the wheel blank 22 or 24 and moving same toward the shaping wheel 32 along a path designated by the arrow 36. The apparatus 20 is not limiting to the invention and may be any types of shaping apparatuses having a power driven wheel and an adjustable and moveable mandrel 34.

In the practice of the invention the wheel blank 22 or 24 is mounted on stem 38 of adjustable mandrel arm 40. A polishing or grinding compound (not shown) is provided on surface 42 of a shaping disc 44 secured on rigid disc support 45. The shaping wheel 32 rotates at a predetermined speed as the wheel blank 22 is biased against and/or into the shaping disc 44 for a predetermined time to shape the wheel blank 22 into scoring wheel 26 having a radiused scoring surface 28. The time required to shape the wheel blank is a function of (1) stock removal rate of the pad 44, (2) grit size of the grinding or polishing compound, (3) the relative speed of the shaping wheel 32 and blank 22, (4) biasing force urging the shaping wheel 32 and wheel blank 22 against one another and (5) abrasion resistance of the wheel blank material. As the stock removal rate of the pad increases while the remaining parameters remain constant, the shaping time decreases and vice versa. Decreasing the grit size of the grinding or polishing compound while the remaining parameters are constant decreases the shaping time and vice versa. Increasing the speed of the shaping wheel 32 and/or wheel blank 22 or 24 while the remaining parameters are constant decreases the shaping time and vice versa. Increasing the biasing forces urging the shaping wheel and wheel blank against one another while the remaining parameters are constant decreases the shaping time and vice versa. With specific reference to FIG. 4, the radius R of the arcuate scoring surface 28 although not limiting to the invention is controlled (1) the angle $\alpha$ (see FIG. 5) subtended by the rotating axis 30 of the wheel blank 22 or 24 or center of the mandrel stem 38 and plane containing the shaping wheel 32 and (2) shaping time of the wheel as discussed above. Increasing the angle while holding the shaping time constant decreases the radius R of the arcuate scoring surface 28 and vice versa. Increasing the shaping time while holding angle constant increases the radius R and vice versa.

In the practice of the invention wheel blanks used are not limiting to the invention. For example, the wheel blank 22 shown in FIG. 2 is similar to apex angle wheels for scoring refractory material. In general, the wheel blank 22 has an included or base angle $\beta$ subtended by surfaces 46 and 48 and a scoring angle $\phi$ subtended by surfaces 50 and 52. When wheel blank 24 shown in FIG. 3 is used it is recommended that an angle e.g. an angle similar to angle $\phi$ of the wheel blank 22 be ground on the periphery of the wheel blank 24 in any convenient manner to minimize shaping time to shape an arcuate scoring surface on the wheel blank. It is recommended that the surface to be shaped have a 1200 grit finish or greater to reduce grit lines on the peripheral surface of the wheel blank. Further, it has been found that better control of the radius R can be attained on surfaces having a 1200 or greater grit finish than those having 1200 or less grit finish.

DETAILED DESCRIPTION OF THE INVENTION

The invention is practiced to shape an arcuate scoring surface 28 having an R of about 0.003 inch (0.00754 centimeter) on a tungsten carbide industrial grade C-2 wheel blank having a diameter of about 7/32 inch (0.56 centimeter), a thickness of about 0.042 inch (0.11 centimeter), a base angle $\beta$ of about 90° and an apex scoring angle $\phi$ of about 150°. The surfaces 50 and 52 forming the scoring angle $\phi$ have a grit finish of about 1200.

A shaping apparatus 20 of the type sold by Harvey Manufacturing Company of Long Island, N.Y., Model No. L.G. 812 has an ¼ inch thick a white polishing felt pad 44 abut ¼ inch (0.64 centimeter) thick of the type sold by GAF Industrial Products Division of New York mounted on rigid pad support 46. The wheel blank 22 is mounted on stem 38 of mandrel 34 and the mandrel adjusted so that angle $\alpha$ is about 75°. Trulap Diamond Compound Grade 24 MW5 sold by Wheel Truing Tool Company of North Carolina is spread on surface 42 of the pad 44. The shaping wheel 32 is rotated at a speed of about 500 revolutions per minute as the table is moved to urge the surface 50 of the blank into the pad surface 42 a distance of about 0.010 inch (0.025 centimeter) for about 15 seconds. The rotating shaping wheel 32 rotates the wheel blank 22 on the mandrel stem 38. The above is repeated for surface 52 of the blank. The resulting scoring wheel 26 is of the type taught in U.S. Pat. No. 4,057,184 which teachings are hereby incorporated by reference and has an arcuate scoring surface having an R of about 0.003 inch (0.008 centimeter).

As can now be appreciated the invention is not limited to the above example which was presented for illustration purpose only. For example, the shaping apparatus may include a spindle 38 that is positively driven for rotating the wheel blank against a stationary shaping wheel 32 or in the alternative both the shaping wheel 32 and the wheel blank may be positively rotated relative to one another. Further, as can now be appreciated, the invention is not limited to the shaping compound nor to the material of the wheel blank.

What is claimed is:

1. A method of forming an arcuate peripheral scoring surface on a wheel for scoring refractory materials, comprising the steps of:

providing a wheel in a first position on a spindle, the wheel having an apex peripheral angle;

positioning a grinding member having a resilient surface relative to the wheel such that the rotating axis of the wheel and plane containing the resilient surface of the grinding member subtend an angle having a value that is greater than zero and the side of the apex peripheral angle facing the resilient surface of the grinding member are non-parallel to one another;

biasing the wheel and grinding member against one another to rotate;

the wheel and grinding member relative to one another to shape an arcuate peripheral scoring surface on one side of the apex peripheral angle; and performing said positioning and biasing steps to shape an arcuate peripheral scoring surface on the other side of the apex peripheral angle to provide a wheel having an arcuate peripheral scoring surface.

2. The method as set forth in claim 1 wherein said providing step includes the step of:

providing a wheel having an apex peripheral angle having a surface finish of at least 1200 grit.

3. The method as set forth in claim 1 or 2 wherein the angle is about ½ the apex peripheral angle of the wheel.

4. The method as set forth in claim 3 wherein said biasing step includes the step of:

rotating the grinding member to rotate the wheel mounted on the spindel; and further including the step of:

adding stock removing compound to the resilient surface of the grinding member.

* * * * *